US007306327B2

(12) United States Patent
Sakai et al.

(10) Patent No.: US 7,306,327 B2
(45) Date of Patent: Dec. 11, 2007

(54) SUBSTRATE FOR INK JET HEAD, INK JET HEAD USING THE SAME, AND MANUFACTURING METHOD THEREOF

(75) Inventors: Toshiyasu Sakai, Yokohama (JP); Ichiro Saito, Yokohama (JP); Sakai Yokoyama, Kawasaki (JP); Teruo Ozaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 230 days.

(21) Appl. No.: 10/536,266

(22) PCT Filed: Dec. 25, 2003

(86) PCT No.: PCT/JP03/16705

§ 371 (c)(1),
(2), (4) Date: May 25, 2005

(87) PCT Pub. No.: WO2004/060680

PCT Pub. Date: Jul. 22, 2004

(65) Prior Publication Data

US 2006/0146095 A1 Jul. 6, 2006

(30) Foreign Application Priority Data

Dec. 27, 2002 (JP) ..... 2002-380821
Dec. 27, 2002 (JP) ..... 2002-380875
Dec. 11, 2003 (JP) ..... 2003-413499

(51) Int. Cl.
*B41J 2/05* (2006.01)

(52) U.S. Cl. ..... 347/63; 347/64

(58) Field of Classification Search ..... 347/20, 347/46, 61–65, 67

See application file for complete search history.

(56) References Cited

U.S. PATENT DOCUMENTS 6,485,131 B1 * 11/2002 Saito et al. ..... 347/64
6,644,790 B2 * 11/2003 Ozaki et al. ..... 347/64
2002/0060721 A1 5/2002 Takada et al. ..... 347/57

FOREIGN PATENT DOCUMENTS

JP 2003-291353 10/2003

* cited by examiner

*Primary Examiner*—Juanita D. Stephens
(74) *Attorney, Agent, or Firm*—Fitzpatrick, Cella, Harper & Scinto

(57) ABSTRACT

The present invention provides a substrate for ink jet including a heating resistor generating thermal energy for discharging an ink from an ink discharge port and an upper protective layer which is formed above the heating resistor and has a contacting surface with the ink. Furthermore, the upper protective layer is made of an amorphous alloy consisting of Ta and Cr in which the content of Ta is more than that of Cr. This constitution allows for the substrate excellent in cavitation resistance and corrosion resistance, and capable of high durability while having similar discharge performance to that of a conventional protective layer made of a Ta film. The present invention further provides an ink jet head comprising the above-mentioned substrate, and a manufacturing method thereof.

8 Claims, 9 Drawing Sheets

SUBSTRATE FOR INK JET HEAD, INK JET HEAD USING THE SAME, AND MANUFACTURING METHOD THEREOF

TECHNICAL FIELD

The present invention relates to a substrate for an ink jet head which discharges a functional liquid such as an ink to a recording medium including paper, plastic sheet, cloth, articles and the like; an ink jet head using the substrate; and a manufacturing method thereof.

BACKGROUND ART

As a general constitution of a head for use in ink jet recording, there can be exemplified a constitution in which a plurality of discharge ports, ink flow paths connected to these discharge ports, and a plurality of electro-thermal conversion elements for generating thermal energy used to jet an ink are provided. Each of the electro-thermal conversion elements has a heating resistor and an electrode for supplying electric power to the heating resistor, and this electro-thermal conversion element is coated with an insulating film to secure insulation between the respective electro-thermal conversion elements. Each ink flow path is connected to a common liquid chamber at an end opposite to the discharge port of the ink flow path, and in the common liquid chamber, the ink supplied from an ink tank as an ink reservoir part is reserved. The ink supplied to the common liquid chamber is led to the respective ink flow paths so that the ink is held forming a meniscus in the vicinity of the discharge port. In this state, the electro-thermal conversion elements are selectively driven to generate thermal energy, and the thus generated energy is then utilized to rapidly heat the ink and to generate bubbles on a thermal action surface, so that the ink is discharged under a pressure caused by such a state change.

The thermal action part of the ink jet head during the ink discharging time is heated by the heating resistor and hence exposed to a high temperature, and simultaneously, the thermal action part combinedly suffers a cavitation impact due to the bubbling and contraction of the ink, and a chemical action of the ink. This chemical action of the ink brings about the following phenomenon. Specifically, color materials, additives and the like contained in the ink are heated at a high temperature, whereby they are decomposed on a molecular level and change into hardly soluble substances, which are physically adsorbed on an upper protective layer. This phenomenon is called kogation. When the hardly soluble organic and inorganic substances are adsorbed on the upper protective layer in this way, thermal conduction from the heating resistor to the ink becomes uneven, and in consequence, the bubbling becomes unstable.

Heretofore, a Ta film which can relatively withstand the cavitation impact and the chemical action of the ink has been formed so as to be a thickness of 0.2 to 0.5 μm, whereby both of life and reliability of the head has been intended.

Referring to FIG. 9, detailed description will be made about a condition caused by the bubbling and bubbling stop of the ink in the thermal action part.

A curve (a) in FIG. 9 shows a change with time of surface temperatures of the upper protective layer from a moment when a voltage is applied to the heating resistor, in a case where a driving voltage $V_{op}=1.3\times V_{th}$ ($V_{th}$ represents an ink bubbling threshold voltage), a driving frequency is set to 6 kHz and a pulse width is set to 5 μs. Furthermore, a curve (b) shows a growing state of formed bubbles from a moment when the voltage is applied to the heating resistor in a similar manner. As shown by the curve (a), the rise of the temperature starts from the moment when the voltage is applied, and a temperature rise peak is observed slightly behind a predetermined pulse time (because the heat from the heating resistor slightly late reaches the upper protective layer). Afterward, the temperature mainly lowers due to thermal diffusion. On the other hand, as shown by the curve (b), the growth of the bubble starts from a time when the temperature of the upper protective layer reaches about 300° C., and after the maximum bubbling is reached, the bubbling stops. In the actual head, the above operation is repeated. In this way, the surface temperature of the upper protective layer rises up to, for example, about 600° C. with the bubbling of the ink, which shows that ink jet recording is carried out with the thermal action at the high temperature.

Accordingly, the upper protective layer which comes in contact with the ink is required to have film properties excellent in heat resistance, mechanical properties, chemical stability, oxidation resistance, alkali resistance and the like. As materials for use in the upper protective layer, in addition to the above-mentioned Ta film, noble metals, high-melting point transition metals, alloys of these metals, nitrides, borides, silicides or carbides of these metals, amorphous silicon or the like are known in the prior art.

For example, as described in Japanese Patent Application Laid-Open No. 2001-105596, an upper protective layer is formed on a heating resistor via an insulating layer, in which the upper protective layer is made of an amorphous alloy represented in a composition formula $Ta_{\alpha}Fe_{\beta}Ni_{\gamma}Cr_{\delta}$ (wherein 10 at. %$\leqq\alpha\leqq$30 at. %, $\alpha+\beta>80$ at. %, $\alpha<\beta$, $\delta>\gamma$, and $\alpha+\beta+\delta+\gamma=100$ at. % are satisfied), and a contacting surface thereof with the ink contains an oxide of the component substance, so that a reliable recording head with a longer service life is proposed.

However, in recent years, the needs for higher quality of record images and higher performance such as high-speed recording in ink jet recording apparatuses have been increased, and in order to meet the needs, enhanced ink performance has been required. For example, improved coloring properties and weather resistance have been demanded in order to address the high-quality record images and also the prevention of bleeding (blur between different color inks) has been demanded in order to address the high-speed recording. Consequently, an attempt to add various components to the ink has been made. With regard to the kinds of ink, in addition to black, yellow, magenta, and cyan, a pale color ink obtained by reducing a concentration or the like has been developed, which has brought about diversification of the ink. In some case, there occurs a phenomenon that even the Ta film, which is conventionally considered to be stable as an upper protective layer, corrodes due to thermochemical reaction with the ink. In the case where the ink containing a bivalent metal salt such as Ca and Mg or a component forming a chelate complex is used, the above-mentioned phenomenon remarkably appears.

In order to further speed up the ink jet recording, driving by shorter pulse than ever (that is, driving with a driving frequency increased) is required. In such shorter pulse driving, since the process of heating, bubbling, bubbling stop and cooling in a thermal action part of a head is repeated in a short period of time, the thermal action part is subjected to a larger thermal stress in a shorter period of time as compared to a conventional one. Furthermore, since the shorter pulse driving concentrates cavitation impact arising from the ink bubbling and contraction on an upper protective layer in a shorter period of time than ever, an upper protective layer particularly excellent in mechanical impact property has been demanded.

While these various improvements in the ink have been advanced, a problem has been found that in the case where an upper protective layer with improved corrosion resistance to the ink as described above is formed, using a certain kind of ink may cause a product due to kogation to be remarkably deposited on a heating portion, thereby reducing discharge performance.

Furthermore, as a manufacturing method of a substrate for ink jet with the above-mentioned upper protective layer formed, a process by dry etching is generally used in many cases. However, in the case where the upper protective layer with improved corrosion resistance to the ink is formed, although high durability can be maintained for a long time, it is predicted that a process of forming a desired pattern or the like by etching or the like becomes difficult. FIGS. 8A to 8E illustrate it. As shown in FIGS. 8A to 8E, in pattern formation of the upper protective layer, the process by dry etching generally used in many cases may cause an insulating protective layer contacting the upper protective layer to be etched. If etching selectivity between the insulating protective layer and the upper protective layer could be sufficiently secured as in a conventional substrate, it would be possible to etch the upper protective layer with the insulating protective layer being left. Actually, over-etching at a boundary portion with the upper protective layer may produce a step (between A and B in FIG. 8E). Owing to such a phenomenon, the insulating protective layer becomes thinner at the boundary portion by etching so as to have a film thickness b smaller than a designed film thickness b, which leads to insufficient exertion of a protective function thereof. Therefore, it is necessary to obtain conditions of control based on etching time in consideration of an etching rate of the upper protective layer by an etching gas to etch only the upper protective layer and then to perform patter formation. A problem, however, has been found that since the upper protective layer may be left unetched or, on the contrary, the insulating protective layer may be etched due to unevenness attributed to devices or etching conditions, the pattern formation of the upper protective layer may not be performed stably.

DISCLOSURE OF THE INVENTION

It is an object of the present invention to provide an ink jet head having a protective layer excellent in cavitation resistance and corrosion resistance, and capable of high durability while having discharge performance similar to that of a conventional protective layer made of a Ta film.

It is another object of the present invention to provide a substrate for an ink jet head comprising a protective layer which has a long service life even if small dots corresponding to fine record images, high-speed driving corresponding to high-speed recording or various kinds of ink are used, an ink jet head comprising the substrate, and a manufacturing method thereof.

It is a still another object to provide a substrate for ink jet including a heating resistor generating thermal energy for discharging an ink from an ink discharge port, and an upper protective layer provided above the heating resistor and having a contacting surface with the ink, the upper protective layer being made of an amorphous alloy consisting of Ta and Cr in which the content of Ta is more than that of Cr, an ink jet head comprising the substrate, and a manufacturing method thereof.

BEST MODE FOR CARRYING OUT THE INVENTION

Figure 1:
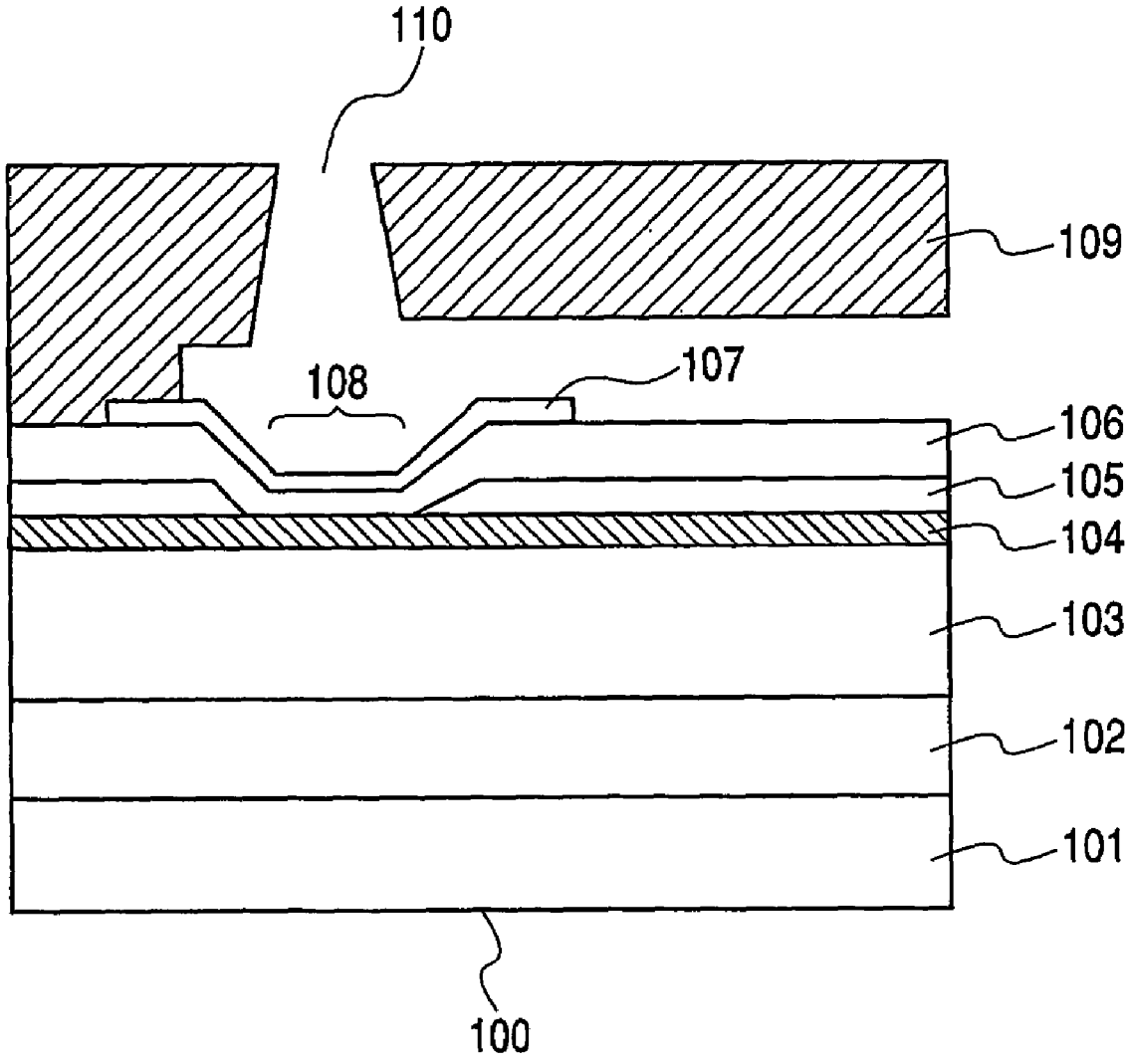
FIG. 1 is a fragmentally cross-sectional view showing a substrate for an ink jet head to which the present invention is applied.

FIG. 1 is an exemplary fragmentally cross-sectional view showing a substrate for the ink jet head to which the present invention may be applied.

In FIG. 1, reference numeral 101 denotes a silicon substrate, reference numeral 102 denotes a heat accumulating layer made of a thermal-oxidized film. Reference numeral 103 denotes an interlayer film made of an SiO film, SiN film or the like which also has a function of accumulating heat, reference numeral 104 denotes a heat resistive layer, reference numeral 105 denotes a metal wiring layer serving as wiring made of a metallic material such as Al, Al—Si, and Al—Cu, reference numeral 106 denotes a protective layer made of an SiO film, SiN film or the like which also serves as an insulating layer. Reference numeral 107 denotes an upper protective layer provided on the protective layer 106 for protecting an electro-thermal conversion element from chemical and physical impact arising from heating of the heating resistor. Furthermore, reference numeral 108 denotes a thermal action part in which heat generated in the heat resistive element of the heating resistive layer 104 acts on ink.

The thermal action part in the ink jet head is a part which is exposed to high temperatures due to the heat generation in the heating resistor and mainly suffers cavitation impact arising from ink bubbling and bubbling contraction after bubbling or a chemical action of the ink. The thermal action part, therefore, is provided with the upper protective layer 107 for protecting the electro-thermal conversion element from this cavitation impact or chemical action of the ink. This upper protective layer 107 is subjected to dry etching by a chlorine gas or the like after applying a mask of a predetermined pattern or wet etching by hydrofluoric acid, boric acid, hydrochloric acid or the like after applying a resist of a predetermined pattern to be patterned. Thereafter, on the upper protective layer 107, a jet element provided with a discharge port 110 for discharging the ink is formed using a flow path forming member 109.

FIGS. 2A to 2H illustrate a method for forming the jet element of the ink jet head, in which a liquid flow path and the discharge port are formed on the patterned upper protective layer 107.

Figure 2A:
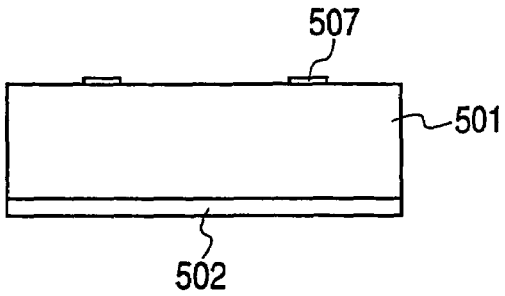
FIGS. 2A, 2B, 2C, 2D, 2E, 2F, 2G and 2H are views illustrating a method for forming a jet element on the substrate for the ink jet head to which the present invention is applied.

As shown in FIG. 2A, an $SiO_2$ film 502 is formed with a thickness of about 2 μm on a lower surface of a substrate for an ink jet head 501 (including the silicon substrate 101, the heat accumulating layer 102, the interlayer film 103, and the heating resistive layer 104, the metal wiring 105, the insulating protective layer 106 and the upper protective layer 107 subjected to predetermined patterning, respectively) under a temperature condition of 400° C. by CVD method. Here, reference numeral 507 corresponds to the thermal action part 108.

Figure 2B:
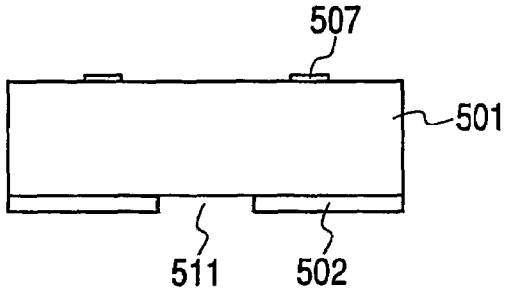

As shown in FIG. 2B, a resist is applied on this $SiO_2$ film 502 to form an opening 511 by dry etching or wet etching after exposure and development. The $SiO_2$ film 502 will serve as a mask when a through-hole 513 is formed later and the through-hole 513 will be formed from the opening 511. Etching of the $SiO_2$ film 502 is performed, for example, in the case of dry etching, by reactive ion etching or plasma etching using $CF_4$ as an etching gas, and in the case of wet etching, using buffered hydrofluoric acid.

Figure 2C:
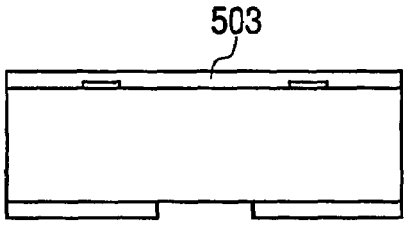

Next, as shown in FIG. 2C, a PSG (phosphosilicate glass) film 503 is formed with a thickness of about 20 μm on the upper surface side of the substrate under a temperature condition of 350° C. by CVD method.

Figure 2D:
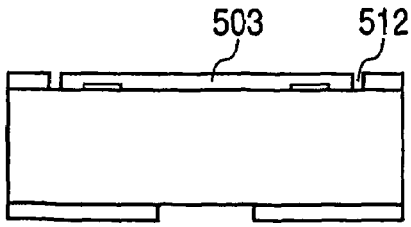

Next, as shown in FIG. 2D, the PSG film 503 is processed to form a predetermined flow path pattern.

Here, it is preferable to process the PSG film by dry etching using a resist, as it does not damage the $SiO_2$ film 502 on the lower surface.

Figure 2E:
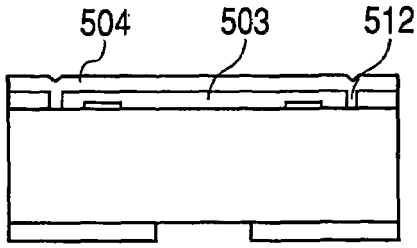

Next, as shown in FIG. 2E, a silicon nitride film 504 is formed with a thickness of about 5 μm on the PSG film 503 formed in the flow path pattern under a temperature condition of 400° C. by CVD method. At this time, an opening 512 is also filled with the silicon nitride film.

Here, since the film thickness of the formed silicon nitride film defines a thickness of the discharge port and the film thickness of the PSG film formed previously defines a gap of the ink flow path, thereby largely affecting ink discharge properties of the ink jet, the film thicknesses of the silicon nitride film and the PSG film are determined according to the required properties.

Figure 2F:
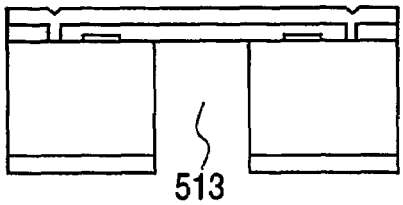

Next, as shown in FIG. 2F, the through-hole 513 is formed on the silicon substrate 501 as an ink supply port by using the $SiO_2$ film as a mask, which has been shapened previously. Although any forming method of the through-hole can be used, ICP (inductively coupled plasma) etching method with $CF_4$ and oxygen used as an etching gas is preferable because it does not electrically damage the substrate and it allows the formation at low temperature.

Figure 2G:
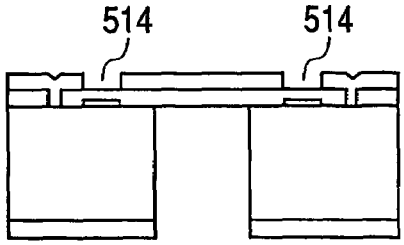

Next, as shown in FIG. 2G, a discharge port 514 is formed by dry etching using the silicon nitride film 504 as a resist. As this forming method, reactive ion etching, which is excellent at anisotropic etching, is used.

Figure 2H:
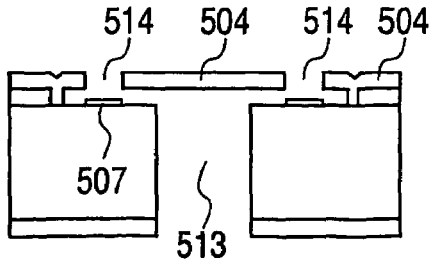

Next, as shown in FIG. 2H, the PSG film 503 is eluted and removed from the discharge port 514 and the through-hole 513 using buffered hydrofluoric acid.

Thereafter, a water repellent film containing Si is formed on a surface of the discharge port by plasma polymerization and an ink supply member (not shown) is attached on the bottom side of the Si substrate 501 to complete the ink jet head.

In addition to dry processes for forming the flow path and the discharge port on the substrate as described above, the following wet processes may be used to manufacture an ink jet head.

On the substrate for the ink jet head 501 (including the silicon substrate 101, the heat accumulating layer 102, the interlayer film 103, and the heating resistive layer 104, the metal wiring 105, the insulating protective layer 106 and the upper protective layer 107 subjected to predetermined patterning, respectively) as shown in FIG. 2A, a resist is applied as a soluble solid layer, which will become an ink liquid flow path in the end, by spin coat method. The resist, made of polymethyl isopropenyl keton, acts as a negative resist and is patterned in a shape of the ink liquid flow path by using a photolithography technique. Subsequently, a coating resin layer is formed to form the liquid flow path or the discharge port. Before forming this coating resin layer, a silane coupling treatment or the like may be performed as required in order to improve adhesion. The coating film layer can be applied on the substrate for the ink jet head with the ink liquid flow path pattern formed by a coating method which can be selected from well-known coating methods. Thereafter, an ink liquid supply port corresponding to 513 is formed from the back side of the substrate for the ink jet head by using anisotropic etching method, sand blast method, anisotropic plasma etching method or the like. Most preferably, chemical silicon anisotropic etching method using tetramethyl hydroxylamine (TMAH), NaOH, KOH or the like may be used to form the ink liquid supply port. Subsequently, whole exposure by Deep-UV light is performed to remove the soluble solid layer and then development and drying are performed.

In any process, the thermal action part of the ink jet head is a part which is exposed to high temperatures due to the heat generation in the heating resistor and mainly suffers cavitation impact arising from ink bubbling and contraction or a chemical action of the ink. Accordingly, the thermal action part is provided with the upper protective layer 107 for protecting the electro-thermal conversion element from this cavitation impact and the chemical action of the ink. The upper protective layer 107 which comes in contact with the ink is required to have film properties excellent in heat resistance, mechanical properties, chemical stability, oxidation resistance, alkali resistance and the like. According to the present invention, there is formed an amorphous alloy consisting of Ta and Cr in which the content of Ta is larger than that of Cr. The amorphous alloy according to the present invention represents an alloy having an amorphous structure, which exhibits no peak showing the presence of a specific crystal plane (or if any, extremely low peaks) and a broad diffraction pattern in crystal structure analysis by X-ray diffraction method.

Supposing the content of Cr in the amorphous alloy is represented by y, it is preferable that $0 \text{ at. \%} < y \leqq 30 \text{ at. \%}$ is satisfied. Furthermore, it is more preferable that $0 \text{ at. \%} < y \leqq 25 \text{ at. \%}$ is satisfied.

The film thickness of this upper protective layer 107 is selected from a range of 50 nm to 500 nm, preferably 100 nm to 300 nm.

Furthermore, the film stress of this upper protective layer has at least compression stress and is preferably not more than $1.0 \times 10^{10}$ dyn/cm$^2$.

In the case where the above-mentioned upper protective layer 107 with improved corrosion resistance is formed, since the surface thereof is hardly damaged because of high corrosion resistance, a product due to kogation tends to be generated easily, which decreases an ink discharge speed or makes the jet itself unstable. It can be supposed that the reason why a smaller amount of kogation product is generated in a Ta film used in a conventional protective layer 107 is that slight corrosion and the kogation product are generated with balance in the Ta film and the surface of the Ta film is scraped due to the slight corrosion to inhibit the kogation product from being deposited.

However, as mentioned above, in the upper protective layer 107 to which an SUS component is added to improve corrosion resistance, when a Ta component is increased to suppress the deposition of the kogation product, the durability cannot be improved. It can be supposed that this is because an increase of the Ta component results in a decrease of the SUS component, which decreases a Cr component considered to contribute to the durability.

The upper protective layer 107 to which the present invention is applied is amorphized by adding chemically stable Cr to the conventional Ta layer and spots where crystal interfaces exist, which become starting points of corrosive reactions, are significantly reduced, thereby improving the corrosion resistance as compared to the conventional Ta layer.

Furthermore, since the upper protective layer 107 to which the present invention is applied has a composition of a high Ta content, the surface of the upper protective layer slightly corrodes to suppress the deposition of the kogation product, which allows the same degree of discharge performance as that of the conventional Ta layer to be maintained.

Here, referring to FIGS. 5A to 5D, differences between the conventionally used Ta layer and the TaCr film according to the present invention will be described.

Figure 5A:
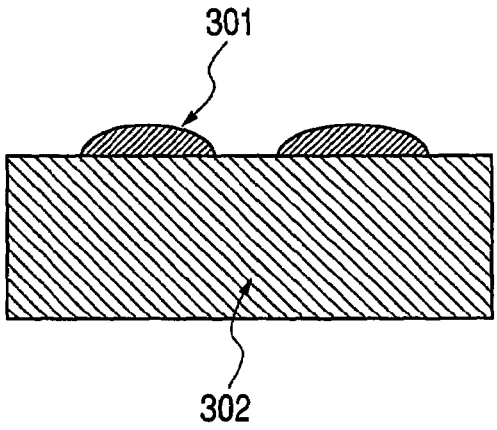
FIGS. 5A, 5B, 5C and 5D are explanatory views illustrating the states of burnt deposition and its separation in an upper protective layer.
Figure 5B:
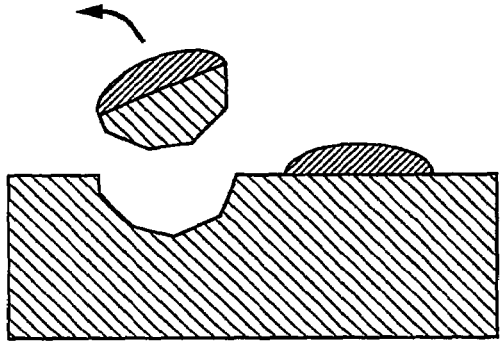

FIG. 5A is an exemplary view showing the upper protective layer 107 and an interface with the ink in the case where the upper protective layer 107 is made of the conventional Ta layer. A kogation product 301 is deposited in the thermal action part by driving the heating resistor. In addition, Ta of the upper protective layer 107 makes up an oxidized film 302 by heat generated during driving. The film thickness of this oxidized film is increased as the number of driving pulses is increased, and the oxidized film is formed wholly in the film thickness direction in the end. Part of this oxidized film 302 is separated from the upper protective layer 107 together with the deposited kogation product 301 as shown in FIG. 5B. It can be thought that in this way, the deposition of the kogation product 301 is suppressed to maintain the discharge performance and the film thickness of the upper protective layer 107 is reduced.

Figure 5C:
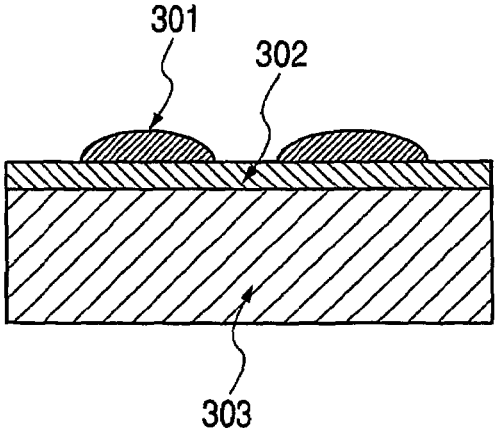
Figure 5D:
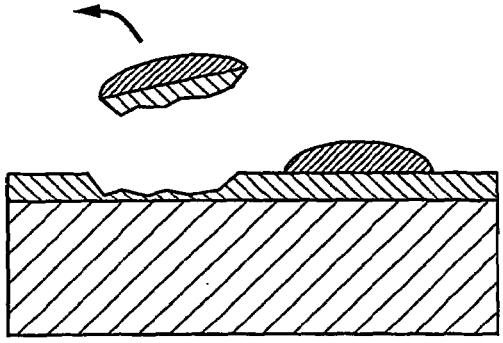

In contrast, as shown in FIG. 5C, in the upper protective layer 107 to which the present invention is applied, the oxidized film 302 in the interface with the ink is formed very thinly on a metal layer 303 as compared to that of the conventional Ta layer. As shown in FIG. 5D, this oxidized film 302 is separated from the upper protective layer 107 together with the deposited kogation product 301 to suppress the deposition of the kogation product 301, which allows the discharge performance to be maintained. At this time, since the oxidized film 302 is formed very thinly as compared to that of the conventional Ta layer, a decrease in the film thickness of the upper protective layer 107 is small, which supposedly improves the durability as compared to the conventional Ta layer.

Thus, the upper protective layer 107 is amorphized by adding chemically stable Cr while having a proper content of Ta, which can improve the corrosion resistance while maintaining the discharge performance.

Furthermore, since the upper protective layer 107 has a composition of a high Ta content, a reduction in the etching rate of the upper protective layer by a chlorine gas can be suppressed to be slight as compared to the conventional Ta. Thereby, the etching quantity of the insulating protective layer is reduced and the reliability can be maintained.

The upper protective layer 107, which can be manufactured by various film forming methods, generally, may be formed by magnetron sputtering method using a radio frequency (RF) power source or a direct current (DC) power source.

Figure 3:
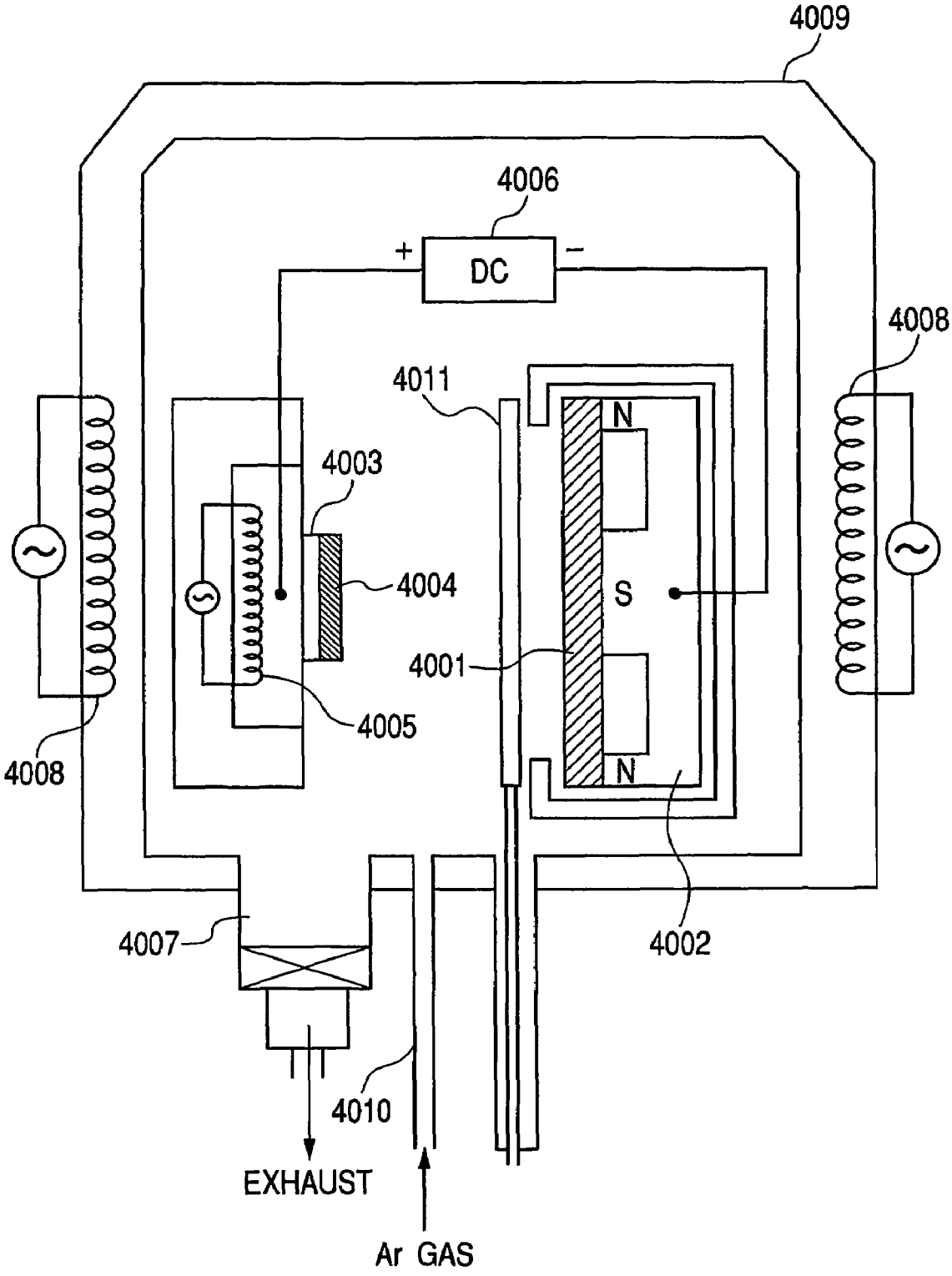
FIG. 3 is an exemplary view showing a film forming apparatus for forming respective layers of the substrate for the ink jet head to which the present invention is applied.

FIG. 3 shows an overview of a sputtering apparatus for forming an upper protective layer.

In FIG. 3, reference numeral 4001 denotes two types of targets consisting of a Ta target and a Cr target. Reference numeral 4002 denotes a flat magnet, reference numeral 4011 denotes a shutter for controlling film formation on a substrate, reference numeral 4003 denotes a substrate holder, reference numeral 4004 denotes the substrate, reference numeral 4006 denotes a power source connected to the target 4001 and the substrate holder 4003. Furthermore, in FIG. 3, reference numeral 4008 denotes an external heater provided in such a manner as to surround an outer peripheral wall of a film formation chamber 4009. The external heater 4008 is used to adjust the ambient temperature of the film formation chamber 4009. An internal heater 4005 for controlling the temperature of the substrate is provided on the back surface of the substrate holder 4003. The temperature control of the substrate 4004 is preferably performed using both internal and external heaters 4005 and 4008.

The film formation using the apparatus of FIG. 3 is performed as follows. Firstly, air is evacuated from the film formation chamber 4009 up to $1\times10^{-5}$ to $1\times10^{-6}$ Pa using an evacuating pump 4007. Next, an argon gas is introduced from a gas introduction port 4010 to the film formation chamber 4009 via a massflow controller (not shown). At this time, the internal heater 4005 and the external heater 4008 are adjusted so as to obtain a predetermined substrate temperature and ambient temperature. Then, power is applied to the target 4001 from the power source 4006, and sputtering discharging is performed to form a thin film on the substrate 4004 while adjusting the shutter 4011.

According to the present invention, the two types of targets, that is the Ta target and the Cr target may be used to form a thin film by binary simultaneous sputtering method in which power is applied from two power sources connected to the respective targets. In this case, the power applied to the respective targets may be controlled separately. Alternatively, a plurality of alloy targets whose compositions have been adjusted in advance are prepared and each of the alloy targets is sputtered separately or two alloy targets or more are sputtered simultaneously to form a thin film with a desired composition.

Furthermore, as describe above, when the upper protective layer 107 is formed, the substrate is heated up to 100° C. to 300° C. to achieve strong film adhesion. In addition, by forming a film by sputtering method capable of forming particles having comparatively large kinetic energy as describe above, strong film adhesion can be achieved.

By making film stress have at least compression stress, and setting it to $1.0\times10^{10}$ dyn/cm$^2$ or less, strong film adhesion can be achieved similarly. This film stress may be adjusted by setting the flow volume of the argon gas introduced to the film forming apparatus, the power applied to the target, or the substrate heating temperature in each case.

The upper protective layer 107 made of the amorphous alloy film according to the present invention is preferably applicable whether the protective layer 106 provided under the upper protective layer 107 is thick or thin.

Figure 4:
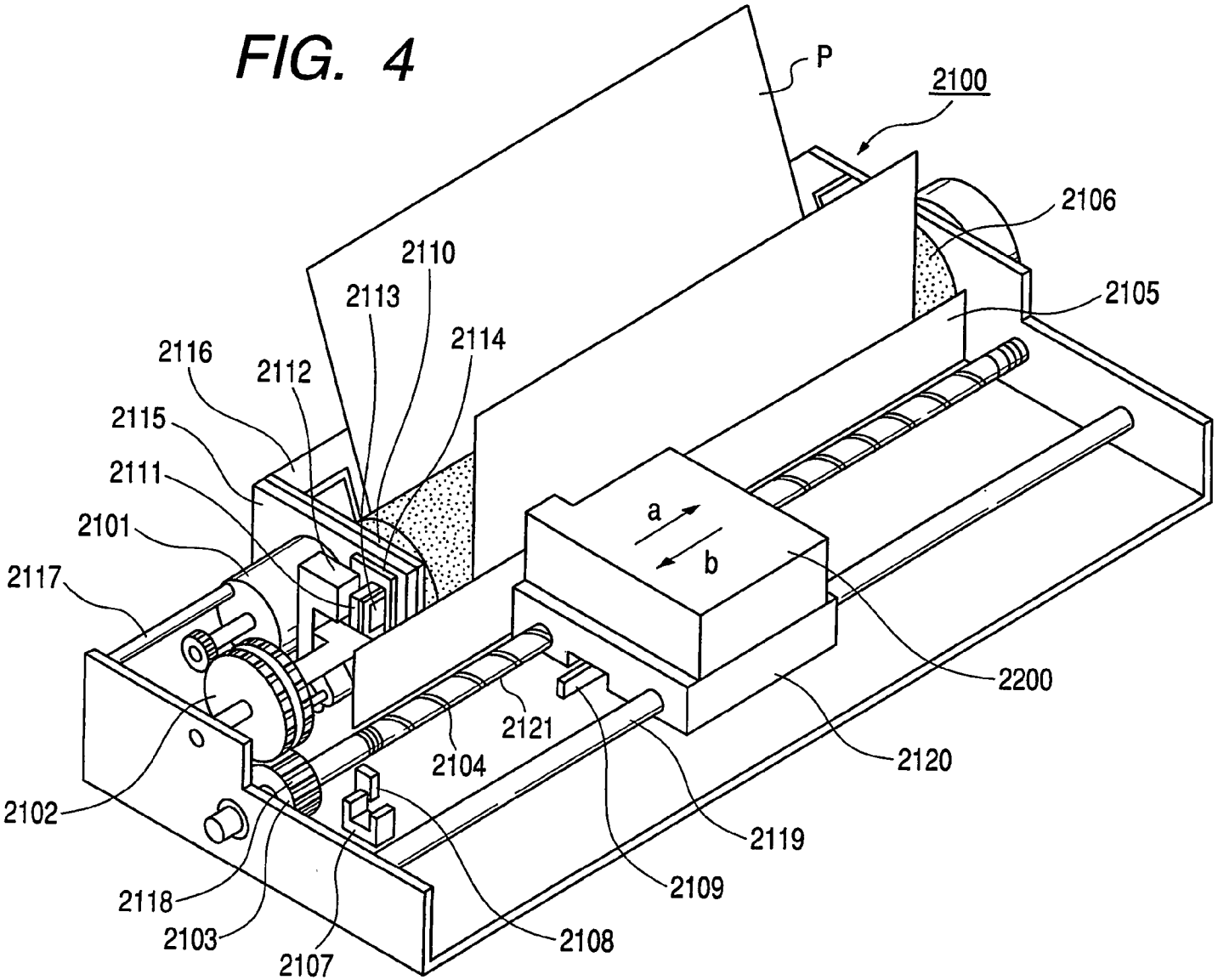
FIG. 4 is an exemplary view showing one constitutional example of an ink jet recording apparatus equipped with the ink jet head to which the present invention is applied.

FIG. 4 is an outline view showing one example of an ink jet apparatus to which the present invention may be applied. Incidentally, although the ink jet apparatus shown in FIG. 4 is of an old type, the present invention applied to a latest ink jet apparatus brings about more effects.

A recording head 2200 is mounted on a carriage 2120 engaged with a spiral groove 2121 of a lead screw 2104 which rotates in conjunction with reciprocal rotation of a driving motor 2101 via driving force transmission gears 2102 and 2103. The recording head 2200 is moved reciprocally in arrow directions a and b along a guide 2119 together with the carriage 2120. A paper pressing plate 2105 for recording paper P fed on a platen 2106 by a recording medium supply device (not shown) presses the recording paper to the platen 2106 across the movement direction of the carriage 2120.

Reference numerals 2107 and 2108 denote photo-couplers which are home position detecting means for confirming the presence of a lever 2109 in this region and switching the rotative direction of the driving motor 2101. Reference numeral 2110 denotes a member supporting a cap member 2111 for capping the entire recording head 2200, and reference numeral 2112 denotes sucking means for sucking the inside of the cap member 2111, by which suction recovery of the recording head 2200 is performed via a cap opening 2113. Reference numeral 2114 denotes a cleaning blade, reference numeral 2115 denotes a moving member enabling this blade to move in the anteroposterior direction. These are supported by a body supporting plate 2116. It is understood that as the cleaning blade 2114, a well-known cleaning blade as well as this embodiment can be applied to this apparatus.

Furthermore, reference numeral 2117 denotes a lever for starting suction for suction recovery which moves with the movement of a cam 2118 engaged with the carriage 2120, and thereby the movement of a driving force from the driving motor 2101 is controlled by publicly known transmission means such as clutch changeover. A recording control unit (not shown) for sending a signal to a heating portion provided in the recording head 2200 or controlling driving of the above-mentioned mechanisms is arranged on the side of a body of the recording apparatus.

The ink jet recording apparatus 2100 constituted as described above performs recording with respect to the recording paper P fed on the platen 2106 by the recording medium supply device while moving the recording head 2200 reciprocally across the entire width of the recording paper P, and since the recording head 2200 is manufactured in the above-mentioned manner, the apparatus can achieve high-precision, high-speed recording.

Hereinafter, the present invention will be described in more detail referring to film formation examples of the upper protective layer and examples of the ink jet head using the upper protective layer made of this alloy film or the like. However, the present invention does not be limited by such examples.

Physical film properties were evaluated in the case where an amorphous alloy layer for use in the upper protective layer 107 according to the present invention was formed on a silicon wafer using the apparatus shown in FIG. 3 in the above-mentioned film forming methods.

Firstly, a thermal-oxidized film was formed on a monocrystal silicon wafer (substrate 4004), which was set on the substrate holder 4003 in the film formation chamber 4009 of the apparatus shown in FIG. 3. Next, air was evacuated from the film formation chamber 4009 up to $8\times10^{-6}$ Pa using the evacuating pump 4007. Thereafter, an argon gas was introduced from the gas introduction port 4010 to the film formation chamber 4009 to set the following conditions inside of the film formation chamber 4009.

Substrate temperature: 200° C.

Gas ambient temperature inside of the film formation chamber: 200° C.

Gas pressure inside of the film formation chamber: 0.3 Pa

Next, either of the Ta target or Cr target was selected in each time and power applied to the respective targets was set as shown in Table 1 to obtain film formation examples 1 to 6. A Ta film was formed in the film formation example 1, a crystallized TaCr film in the film formation example 2, and TaCr films of amorphous structure in the film formation examples 3 to 6, with a film thickness of 200 nm on the thermal oxidized film of the silicon wafer.

Furthermore, the Ta target and a $Ta_{18}Fe_{61}Cr_{15}Ni_6$ target were used and power applied to the respective targets were set as Table 1 to obtain a film formation example 7 of amorphous structure. Furthermore, the Cr target and the $Ta_{18}Fe_{61}Cr_{15}Ni_6$ target were used and power applied to the respective targets were set as Table 1 to obtain a film formation example 8 of amorphous structure.

The above-mentioned obtained samples were subjected to RBS (Rutherford back scattering) analysis for the purpose of composition analysis. The results are shown in Table 1.

Next, X-ray diffraction measurement was performed for the TaCr films of the upper protective layers formed on the silicon wafers as described above for the purpose of structural analysis. As a result, $Ta_{89}Cr_{11}$ exhibited a sharp diffraction peak, while $Ta_{78}Cr_{22}$ exhibited no specific diffraction peak, which showed the transition from crystalline structure to amorphous structure.

Next, the film stress of the respective samples was determined based on the amounts of substrate deformation before and after film formation. As a result, a tendency was observed that as Cr composition is higher, film stress changed from compression stress to tensile stress, and film adhesion was reduced. By making the film stress have at least compression stress and setting it to $1.0\times10^{10}$ dyn/cm$^2$ or less, similarly strong film adhesion could be obtained.

TABLE 1

| | Power [W] | | | Film composition | Crystal |
|---|---|---|---|---|---|
| | Ta | Cr | $Ta_{18}Fe_{61}Cr_{15}Ni_6$ | [at. %] | structure |
| Film formation example 1 | 600 | — | — | Ta | crystalline |
| Film formation example 2 | 700 | 80 | — | $Ta_{89}Cr_{11}$ | crystalline |
| Film formation | 600 | 150 | — | $Ta_{78}Cr_{22}$ | amorphous |

TABLE 1-continued

| | Power [W] | | | Film composition | Crystal |
|---|---|---|---|---|---|
| | Ta | Cr | $Ta_{18}Fe_{61}Cr_{15}Ni_6$ | [at. %] | structure |
| example 3 | | | | | |
| Film formation example 4 | 600 | 100 | — | $Ta_{74}Cr_{26}$ | amorphous |
| Film formation example 5 | 500 | 150 | — | $Ta_{70}Cr_{30}$ | amorphous |
| Film formation example 6 | 500 | 500 | — | $Ta_{40}Cr_{60}$ | amorphous |
| Film formation example 7 | 100 | — | 600 | $Ta_{28}Fe_{52}Cr_{15}Ni_5$ | amorphous |
| Film formation example 8 | — | 100 | 800 | $Ta_{17}Fe_{54}Cr_{25}Ni_4$ | amorphous |

(Relation Between Constitution of Upper Protective Layer and Kogation)

EXAMPLE 1

As a sample substrate to be evaluated with respect to ink discharge properties according to the present invention, an Si substrate or an Si substrate with a driving IC embedded was used. In the case of the Si substrate, an $SiO_2$ heat accumulating layer 102 (refer to FIG. 1) with a thickness of 1.8 μm was formed by thermal oxidization method, sputtering method, CVD method or the like, and in the case of the Si substrate with IC embedded, an $SiO_2$ heat accumulating layer was formed similarly in the manufacturing process.

Next, an interlayer insulating film 103 made of $SiO_2$ with a thickness of 1.2 μm was formed by sputtering method, CVD method or the like. Then, a heating resistor 104 represented in a composition formula of $Ta_{40}Si_{21}N_{39}$ with a thickness of 50 nm was formed by reactive sputtering method using a Ta—Si target. At this time, the substrate temperature was 200° C. An Al film was formed with a thickness of 200 nm as metal wiring 105.

Next, patterning was performed using photolithography and a thermal action part 108 of 30 μm×30 μm with the Al film removed was formed. Then, an insulator made of SiN with a thickness of 300 nm was formed as a protective layer 106 by plasma CVD method. Thereafter, $Ta_{78}Cr_{22}$ was formed with a thickness of 230 nm as an upper protective layer 107 under the conditions of the film formation example 3 shown in Table 1. Subsequently, the upper protective layer 107 was patterned by dry etching to manufacture a substrate for ink jet. In this case, it is preferable to employ TaCr films produced in Examples 7 to 15 described later.

Furthermore, as described above, the upper protective layer 107 may be patterned by wet etching using hydrofluoric acid instead of dry etching to manufacture a substrate for an ink jet head.

Next, the ink jet head was manufactured using the substrate for ink jet manufactured in either method. Then, discharge properties were evaluated using this ink jet head mounted on such an ink jet recording apparatus as shown in FIG. 4.

In this test, discharge speeds of the respective samples were measured after applying a driving signal of $1\times10^8$ pulses with a pulse width set to 1 μsec at a driving frequency of 5 kHz. At this time, a driving voltage $V_{op}$ was $V_{th}\times1.15$. In addition, a commercially available ink for an ink jet printer (trade name: BCI-3e-Bk produced by Canon Inc.) was used. $V_{th}$ represents a bubbling threshold voltage at which the ink is discharged.

In Example 1, although the discharge speed was measured after applying the driving signal of $1\times10^8$ pulses, no sufficiently major decrease could be observed to affect ink discharge properties. Furthermore, by observing the surface of the heating resistor after evaluation, slight adhesion of a kogation product was confirmed.

EXAMPLES 2 AND 3

TaCr films having different compositions were formed with a thickness of 230 nm using a similar method to that of Example 1 to be evaluated with respect to ink discharge properties. The results are shown in Table 2.

COMPARATIVE EXAMPLES 1 TO 3

Ink discharge properties were evaluated using a similar method to that of Example 1. As comparative examples, a Ta film, a $Ta_{40}Cr_{60}$ film, and a $Ta_{28}Fe_{52}Cr_{15}Ni_5$ film each having a thickness of 230 nm were evaluated. The results are shown in Table 2.

TABLE 2

| | Film composition [at. %] | Crystal structure | Jet speed | Kogation product |
|---|---|---|---|---|
| Example 1 | $Ta_{78}Cr_{22}$ | amorphous | good | slight amount |
| Example 2 | $Ta_{74}Cr_{26}$ | amorphous | good | slight amount |
| Example 3 | $Ta_{70}Cr_{30}$ | amorphous | good | slight amount |
| Comp. Example 1 | Ta | crystalline | good | small amount |
| Comp. Example 2 | $Ta_{40}Cr_{60}$ | amorphous | not good, not bad | large amount |
| Comp. Example 3 | $Ta_{28}Fe_{52}Cr_{15}Ni_5$ | amorphous | bad | large amount |

As shown in Table 2, in the TaCr films of Examples 1 to 3 and the Ta film of Comparative Example 1, the discharge speeds were maintained after applying the driving signal of $1\times10^8$ pulses. In contrast, in Comparative Examples 2 and 3, the discharge speeds were reduced so that desired recording image quality could not be maintained. The ink jet heads used for this jet property evaluation were disassembled to observe the generation of the kogation product at the thermal action parts thereof. As a result, in Comparative Examples 2 and 3, in which the discharge speeds were largely reduced, a large amount of kogation product was observed to be deposited on the thermal action parts. Thereby, it was confirmed that the reduction in the discharge speed of the ink jet head was attributed to the deposition of the kogation product. This showed that as the content of Ta was decreased, the deposition of the kogation product became remarkable, which prevented the discharge properties from being maintained.

EXAMPLE 4

A discharge durability test was conducted using a similar ink jet head to that of Example 1. In this test, service life was detected when the jet was continued at a driving frequency of 5 kHz with a pulse width set to 1 μsec until the ink jet recording head was disabled to jet ink. At this time, the driving voltage $V_{op}$ was $V_{th}$×1.15. In addition, an ink containing about 4% of a bivalent metal with a nitric acid group, $Ca(NO_3)_2.4H_2O$ was used. The results are shown in Table 3.

As shown in Table 3, even when the driving signal was continuously applied up to $1.0\times10^9$ pulses to continuously jet the ink, stable jet was possible.

EXAMPLES 5 AND 6

Ink jet heads were prepared in a similar method to that of Example 4 except that a $Ta_{74}Cr_{26}$ film (in Example 5) and a $Ta_{70}Cr_{30}$ film (in Example 6) were formed as the upper protective layers 107, respectively. Jet proof-tests were conducted in a similar method to that of Example 4 using these ink jet heads. The results are shown in Table 3.

COMPARATIVE EXAMPLES 4 AND 5

Ink jet heads were prepared in a similar method to that of Example 4 except that a Ta film (in Comparative Example 4) and a $Ta_{89}Cr_{11}$ film (in Comparative Example 5) were formed as the upper protective layers 107, respectively. Jet proof-tests were conducted in a similar method to that of Example 4 using these ink jet heads. The results are shown in Table 3.

As shown in Table 3, in Comparative Examples 4 and 5, breaking occurred before reaching the application of a driving signal of $4\times10^8$ pulses so that the jet was disabled.

The above-mentioned results showed the following. As shown in the results of Table 3, it was found that durability shown in the discharge durability tests clearly depended on its crystal structure and a change into amorphous structure increased the durability.

TABLE 3

| | Film composition [at. %] | Crystal structure | Pulse number of normal jet |
|---|---|---|---|
| Example 4 | $Ta_{78}Cr_{22}$ | amorphous | $1.0 \times 10^9$ pulses or more |
| Example 5 | $Ta_{74}Cr_{26}$ | amorphous | $1.0 \times 10^9$ pulses or more |
| Example 6 | $Ta_{70}Cr_{30}$ | amorphous | $1.0 \times 10^9$ pulses or more |
| Comparative Example 4 | Tr | crystalline | $4.0 \times 10^8$ pulses or less |
| Comparative Example 5 | $Ta_{89}Cr_{11}$ | crystalline | $4.0 \times 10^8$ pulses or less |

Figure 6A:
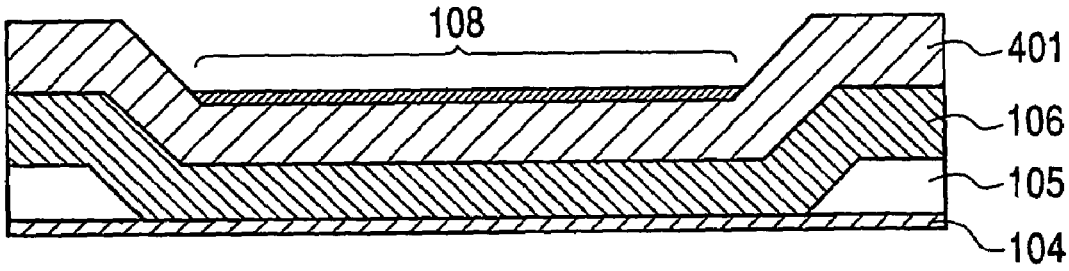
FIGS. 6A, 6B and 6C are exemplary views showing cross-sections of heating elements observed in a discharge durability test.
Figure 6B:
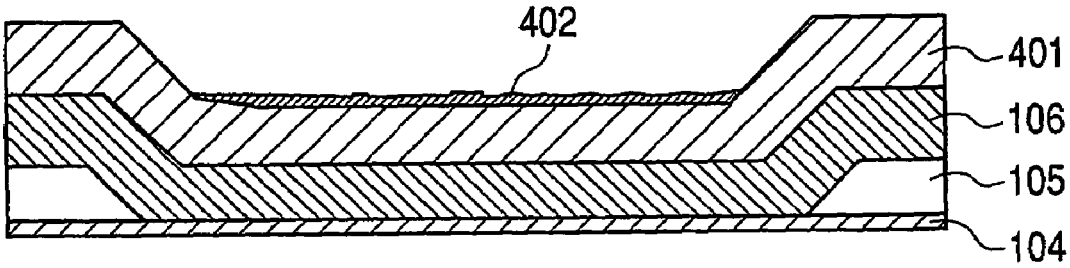
Figure 6C:
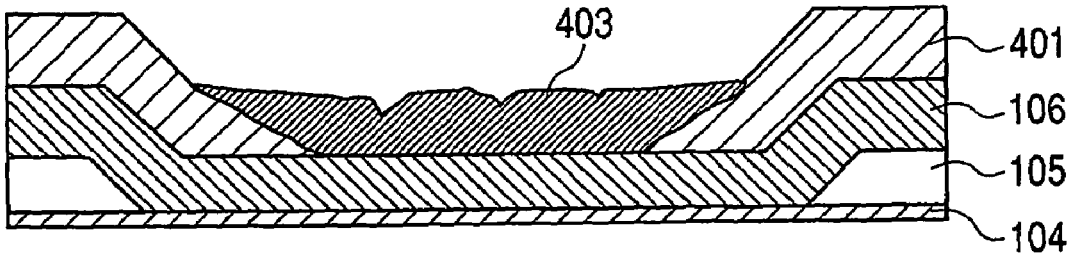

For an heating resistor of the ink jet head of Example 4, in which the discharge durability test was conducted until the driving signal of $1\times10^9$ pulses was applied and an unbroken heating resistor of the ink jet head of Comparative Example 4, in which the discharge durability test was conducted until part of a plurality of heating resistors were broken, cross-sectional observation was conducted. Their exemplary views were shown in FIGS. 6A to 6C. Here, FIG. 6A shows an initial state of Example 4 and Comparative Example 4, and reference numeral 401 denotes a layer corresponding to the upper protective layer 107 which is the $Ta_{78}Cr_{22}$ film in Example 4 and the Ta film in Comparative Example 4. Furthermore, the reference numeral 108 denotes the thermal action part, the reference numeral 106 denotes the insulating protective layer, the reference numeral 105 denotes the metal wiring, and the reference numeral 104 denotes the heating resistive layer. FIG. 6B is an exemplary cross-sectional view after the discharge durability test was conducted until the driving signal of $1.0\times10^9$ pulses was applied to the heating resistor of the ink jet head of Example 4, and reference numeral 402 denotes an oxidized film formed on the upper protective layer 107. FIG. 6C is an exemplary cross-sectional view of the unbroken heating resistor when the part of the heating resistors of the ink jet head of Comparative Example 4 were broken before reaching the application of the driving signal of $4\times10^8$ pulses, and reference numeral 403 denotes an oxidized film formed on the upper protective layer 107.

From these results, in Comparative Example 4, it was observed that most of Ta on the thermal action part was oxidized as shown in the oxidized film 403 and there existed regions which were locally depressed deeply in the oxidized film. It can be supposed that in the broken heating resistor of Comparative Example 4, this corrosion reached the heating resistive layer 104, which caused breaking.

In contrast, in Example 4, the extremely thin oxidized film 402 was formed on the upper protective layer 107 (401) on the thermal action 108. The thickness was about 10 nm. Although the entire film thickness was slightly decreased to about 190 nm, most of the film remained in a metal state. As a result, it can be supposed that favorable discharge properties were maintained while maintaining durability in spite of the generation of the kogation product by a structure in which such an oxidized film 402 was formed.

As described above, according to Examples 1 to 6, in an ink jet head in which a kogation product was generated on an upper protective layer having an contacting surface with an ink by driving of a heating resistor, by forming the upper protective layer made of an amorphous alloy consisting of Ta and Cr in which the content of Ta is more than that of Cr, it became possible to provide an ink jet head excellent in cavitation resistance and corrosion resistance, and capable of high durability while having discharge performance similar to that of a conventional protective layer made of a Ta film.

(2) Relation Between Constitution of Upper Protective Layer and Etching

Next, the fact will be described below that in the case where the upper protective layer of the substrate for ink jet used in the above-mentioned experiments is formed and patterned by dry etching, the upper protective layer to which the present invention is applied brings about an exceptional effect.

Firstly, there were prepared samples in which photoresists were patterned in a predetermined shape on the metal films with respective compositions using the films according to the film formation examples 1 to 8, and dry etching was performed to the respective samples at a power of 300 W while introducing a $Cl_2$ gas at a flow of 100 sccm at a pressure of 1 Pa using a reactive ion etching apparatus. The results are shown in FIG. 7.

Figure 7:
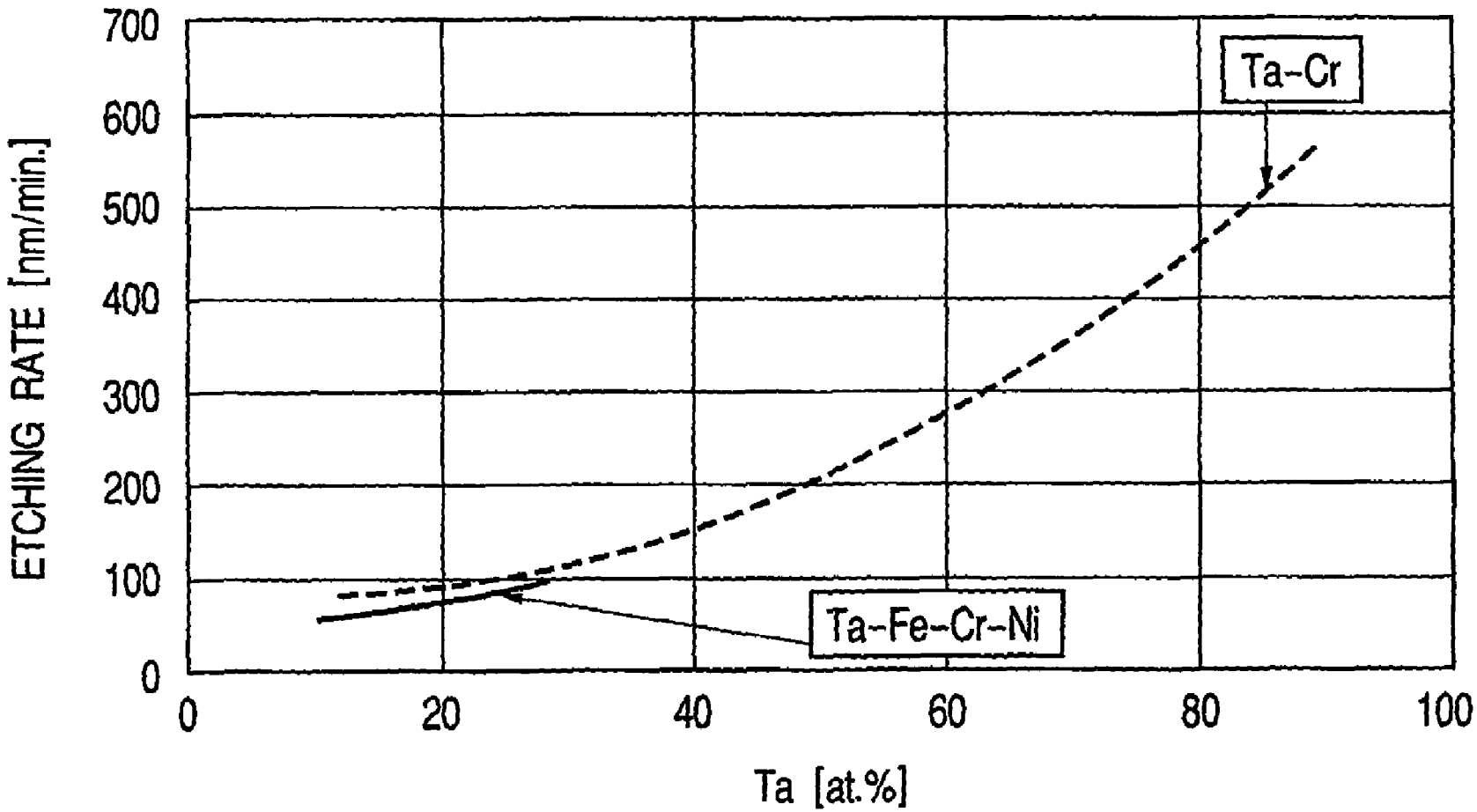
FIG. 7 is a graph showing an etching rate in relation to the content of Ta.

FIG. 7 shows that in the case where the dry etching was performed using the $Cl_2$ gas, the etching rate depends on the content of Ta and is decreased with a decrease of the content of Ta.

Although in this experiment, dry etching was performed using the $Cl_2$ gas, a mixed gas of the $Cl_2$ gas and other gases or cases using other gases exhibited a similar tendency.

Using the substrates for ink jet manufactured in such a manner, reliability was evaluated as described below.

EXAMPLE 7

A reliability test was conducted in order to evaluate reliability of the protective layer after the upper protective layer 107 was subjected to dry etching.

FIGS. 8A to 8E are exemplary cross-sectional views of a substrate for ink jet. Here, the reference numeral 106 denotes the insulating protective layer, the reference numeral 107 denotes the upper protective layer, reference numeral 521 denotes a heater substrate including the silicon substrate 101, the heat accumulating layer 102, the interlayer film 103, the heating resistive layer 104, and the metal wiring 105. Reference numeral 522 abstractly illustrates the thermal part 108 formed of the heating resistor layer 104 and the metal wiring 105 with such a constitution as shown in FIG. 1. Furthermore, reference numeral 523 denotes a resist.

Figure 8A:
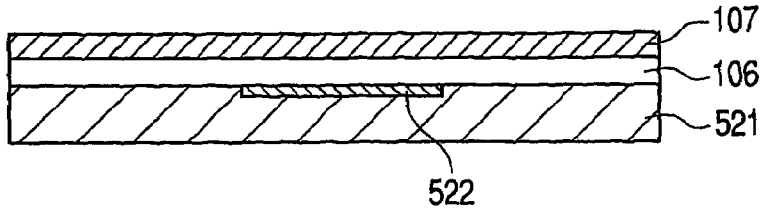
FIGS. 8A, 8B, 8C, 8D and 8E are views showing how the upper protective layer is subjected to dry etching.
Figure 8B:
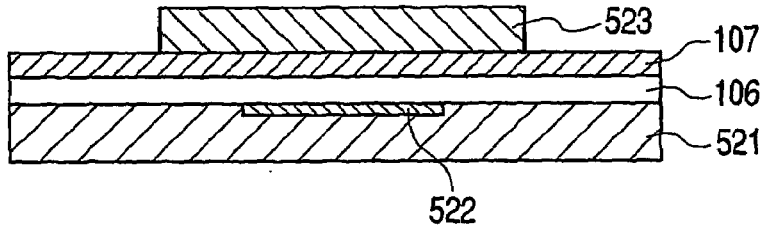
Figure 8C:
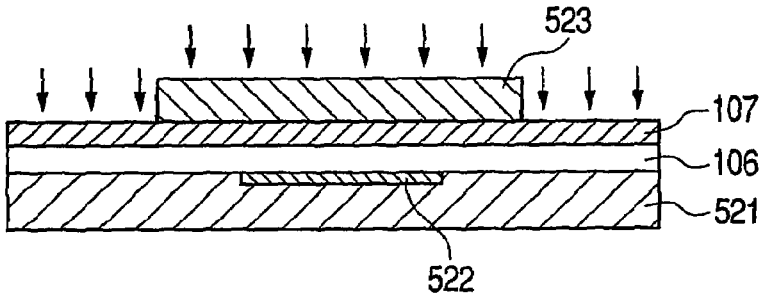
Figure 8D:
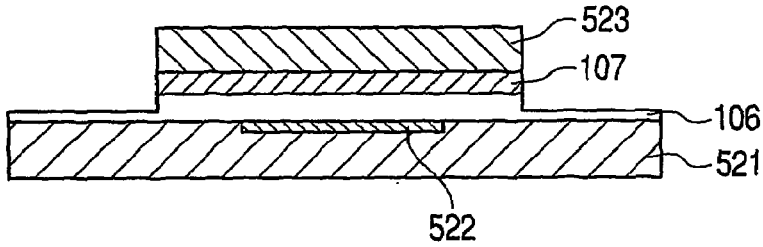
Figure 8E:
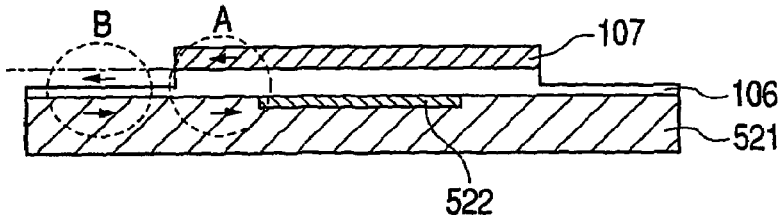
Figure 9:
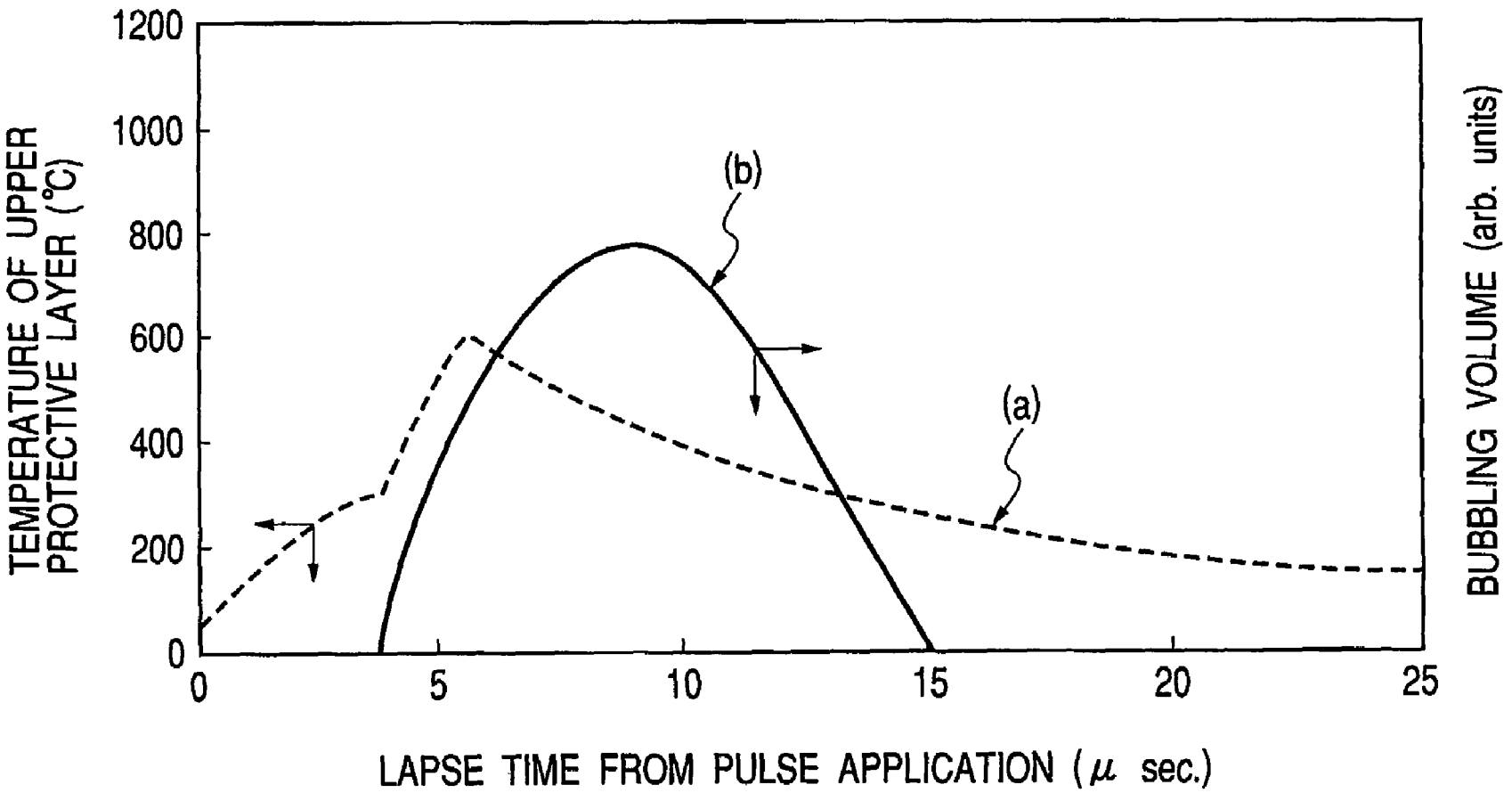
FIG. 9 is a graph illustrating changes in temperature and a bubbling state of the upper protective layer after applying a voltage.

In this test, it is evaluated whether or not the coverage by the insulating protective layer is insufficient by etching up to the insulating protective layer under the upper protective layer (a part B in FIG. 8E). For this evaluation, the substrate for ink jet was immersed in a BHF (buffered hydrofluoric acid) solution for 20 minutes, and further immersed in a 3% NaOH (sodium hydroxide) solution for 10 minutes. Etching conditions were set on the basis of an etching rate set in advance so that 20% over-etching might be performed. With respect to Example 7, it was observed whether or not erosion was developing from the part where the insulating protective layer was etched (the part B in FIG. 8E). As a result, from the fact that no part where the erosion was developing was found, it was confirmed that the reliability of the protective layer was maintained.

EXAMPLES 8 TO 12

The reliability tests were conducted with respect to TaCr films with different compositions in a similar method to that of Example 7. The results are shown in Table 4.

COMPARATIVE EXAMPLES 6 TO 9

The reliability tests were conducted in a similar method to that of Example 7. As comparative examples, a Ta film, a $Ta_{40}Cr_{60}$ film, a $Ta_{28}Fe_{52}Cr_{15}Ni_5$ film, and a $Ta_{17}Fe_{54}Cr_{25}Ni_4$ film were evaluated. The results are shown in Table 4.

TABLE 4

| | Film composition [at. %] | Insulating protective layer | Film thickness [nm] | Immersion test in BHF and 3% NaOH solutions |
|---|---|---|---|---|
| Example 7 | $Ta_{78}Cr_{22}$ | SiN | 230 | good |
| Example 8 | $Ta_{89}Cr_{11}$ | SiN | 230 | good |
| Example 9 | $Ta_{74}Cr_{26}$ | SiN | 230 | good |

TABLE 4-continued

| | Film composition [at. %] | Insulating protective layer | Film thickness [nm] | Immersion test in BHF and 3% NaOH solutions |
|---|---|---|---|---|
| Example 10 | $Ta_{70}Cr_{30}$ | SiN | 230 | good |
| Example 11 | $Ta_{55}Cr_{45}$ | SiN | 230 | not good, not bad |
| Example 12 | $Ta_{55}Cr_{45}$ | SiN | 150 | good |
| Comp. Example 6 | Ta | SiN | 230 | good |
| Comp. Example 7 | $Ta_{40}Cr_{60}$ | SiN | 230 | bad |
| Comp. Example 8 | $Ta_{28}Fe_{52}Cr_{15}Ni_5$ | SiN | 230 | bad |
| Comp. Example 9 | $Ta_{17}Fe_{54}Cr_{25}Ni_4$ | SiN | 230 | bad |

As shown in Table 4, in Comparative Examples 7 to 9, a number of erosions of the wiring layer were observed in the part B of FIG. 8E since etching invaded the insulating protective layer. In contrast, in Examples 7 to 10 and Comparative Example 6, erosions were not observed, which showed the reliability of the insulating protective layer was maintained. Furthermore, in Example 11, a few erosions were observed due to a decrease of the etching rate, while in such a case as Example 12, in which the film thickness was thin, the etching quantity of the insulating protective layer was decreased since the etching time was decreased, and no corrosion was observed in the reliability test.

These results showed that since the etching rate was decreased with a decrease of the content of Ta, the etching advanced up to the protective layer, which made the coverage insufficient.

EXAMPLES 13 TO 15

Similar reliability tests to that of Table 3 were conducted using similar substrates for ink jet to those of Examples 9 to 11 except that SiO was used for the protective layer 106. The results are shown in Table 5.

COMPARATIVE EXAMPLE 10

A similar reliability test to that of Table 4 was conducted using a similar substrate for ink jet to those of Examples 13 to 15 except that $Ta_{17}Fe_{54}Cr_{25}Ni_4$ was used for the upper protective layer. The results are shown in Table 5.

TABLE 5

| | Film composition [at. %] | Insulating protective layer | Film thickness [nm] | Immersion test in BHF and 3% NaOH solutions |
|---|---|---|---|---|
| Example 13 | $Ta_{74}Cr_{26}$ | SiO | 230 | good |
| Example 14 | $Ta_{70}Cr_{30}$ | SiO | 230 | good |
| Example 15 | $Ta_{55}Cr_{45}$ | SiO | 230 | good |
| Comp. Example 10 | $Ta_{17}Fe_{54}Cr_{25}Ni_4$ | SiO | 230 | bad |

As shown in Table 5, in Examples 13 to 15, no corroded part was observed. This is because since the etching rate of SiO is lower than that of SiN and the protective layer 106 is made of SiO, the coverage of the protective layer is maintained. In contract, In Comparative Example 10, a number of corrosions were observed.

Although the reliability of the insulating protective layer can be maintained even in a region having a low content of Ta by making the TaCr film thinner or by selectively changing a base material to a proper one, it is preferable that the content of Cr is 30 at. % or less in order to strike a balance between the durability and the reliability of the insulating protective layer.

As described above, according to the above-mentioned Examples 7 to 15, in a substrate for an ink jet head having an insulating protective layer provided on a heating resistor and an upper protective layer formed on the insulating protective layer and patterned by dry etching, by forming the upper protective layer made of an alloy consisting of Ta and Cr in which the content of Ta is more than the content of Cr, the protective ability of the insulating protective layer in contact with the upper protective layer can be inhibited from being reduced even if the upper protective layer is patterned by dry etching. As a result, it becomes possible to provide an ink jet head having a protective layer excellent in cavitation resistance and corrosion resistance, and capable of high durability. In particular, by embodying the ink jet head together with the constitutions described in Examples 1 to 15, higher cavitation resistance, corrosion resistance, and durability can be achieved.

The invention claimed is:

1. A substrate for an ink jet head comprising:

a heating resistor generating thermal energy for discharging an ink;

an insulating protective layer provided above the heating resistor; and an upper protective layer formed above the insulating protective layer and having a contacting surface with the ink, the upper protective layer being made of an amorphous alloy consisting of Ta and Cr, the content of Cr being 30 at. % or less.

2. The substrate for the ink jet head according to claim 1, wherein the film thickness of the upper protective layer is in a range of 50 nm to 500 nm.

3. The substrate for the ink jet head according to claim 1, wherein the film stress of the upper protective layer has at least compression stress and is $1.0\times10^{10}$ dyn/cm$^2$ or less.

4. An ink jet head comprising:

an ink discharge port; and a substrate having a heating resistor generating thermal energy for discharging an ink from said ink discharge port; and an upper protective layer formed above an insulating protective layer and having a contacting surface with the ink, the upper protective layer being made of an amorphous alloy consisting of Ta and Cr, the content of Cr being 30 at. % or less.

5. The substrate for the ink jet head according to claim 4, wherein the film thickness of the upper protective layer is in a range of 50 nm to 500 nm.

6. The substrate for the ink jet head according to claim 4, wherein the film stress of the upper protective layer has at least compression stress and is $1.0\times10^{10}$ dyn/cm$^2$ or less.

7. A manufacturing method of a substrate for an ink jet head comprising:

a step of forming a heating resistor and an insulating protective layer in this order on a substrate;

a step for forming an amorphous layer made of an amorphous alloy consisting of Ta and Cr above said insulating protective layer, the content of Cr being 30 at. % or less; and a step of forming an upper protective layer by patterning the amorphous layer with dry etching.

8. The manufacturing method according to claim 7, wherein the patterning of the upper protective layer is patterning with dry etching using a chloride gas.

* * * * *

UNITED STATES PATENT AND TRADEMARK OFFICE

CERTIFICATE OF CORRECTION

PATENT NO. : 7,306,327 B2
APPLICATION NO. : 10/536266
DATED : December 11, 2007
INVENTOR(S) : Sakai et al.

It is certified that error appears in the above-identified patent and that said Letters Patent is hereby corrected as shown below:

COLUMN 3:
Line 37, “patter” should read --pattern--.

COLUMN 8:
Line 53, “describe” should read --described--.
Line 58, “describe” should read --described--.

COLUMN 10:
Line 2, “does not be” should read --is not to be--.

COLUMN 16:
Line 66, “contract, In” should read --contrast, in--.

Signed and Sealed this

Tenth Day of March, 2009

JOHN DOLL
*Acting Director of the United States Patent and Trademark Office*